US005778907A

United States Patent [19]

Ransley, Jr. et al.

[11] Patent Number: 5,778,907

[45] Date of Patent: Jul. 14, 1998

[54] CLEANING SYSTEM FOR ELONGATED OBJECTS

[75] Inventors: Gilbert F. Ransley, Jr., McFarland; Andrew Campos, Middleton; Ronald R. Riebe, Madison, all of Wis.

[73] Assignee: DEC International, Inc., Madison, Wis.

[21] Appl. No.: 757,054

[22] Filed: Nov. 26, 1996

[51] Int. Cl.[6] ..... B08B 3/04

[52] U.S. Cl. ..... 134/25.4; 134/32; 134/73; 134/126; 134/127; 134/131

[58] Field of Search ..... 134/25.4, 32, 67, 134/68, 73, 74, 75, 126, 127, 129, 130, 131

[56] References Cited

U.S. PATENT DOCUMENTS

| | | | |
|---|---|---|---|
| 1,178,166 | 4/1916 | McCue et al. | 134/126 X |
| 1,393,633 | 10/1921 | Moltrup . | |
| 1,561,043 | 11/1925 | Zuckerman | 134/67 X |
| 1,751,838 | 3/1930 | Morgan, Sr. . | |
| 1,757,103 | 5/1930 | Voigt | 134/127 X |
| 2,635,614 | 4/1953 | Ford | 134/74 X |
| 4,567,906 | 2/1986 | Brule | 134/127 |
| 4,765,020 | 8/1988 | Weihe | 134/126 X |
| 4,858,769 | 8/1989 | DeVries | 134/131 X |

*Primary Examiner*—Philip R. Coe
*Attorney, Agent, or Firm*—Quarles & Brady

[57] ABSTRACT

A system for cleaning elongated objects is disclosed. The system utilizes an infeed conveyor without pusher flights and an outfeed conveyor with pusher flights. The conveyors are arranged to form an angular section near the bottom of the tank. A flip back plate rejects objects from the outfeed conveyor so that the objects are continuously circulated from the bottom of the angular section to the top of the angular section.

21 Claims, 7 Drawing Sheets

FIG. 1
(PRIOR ART)
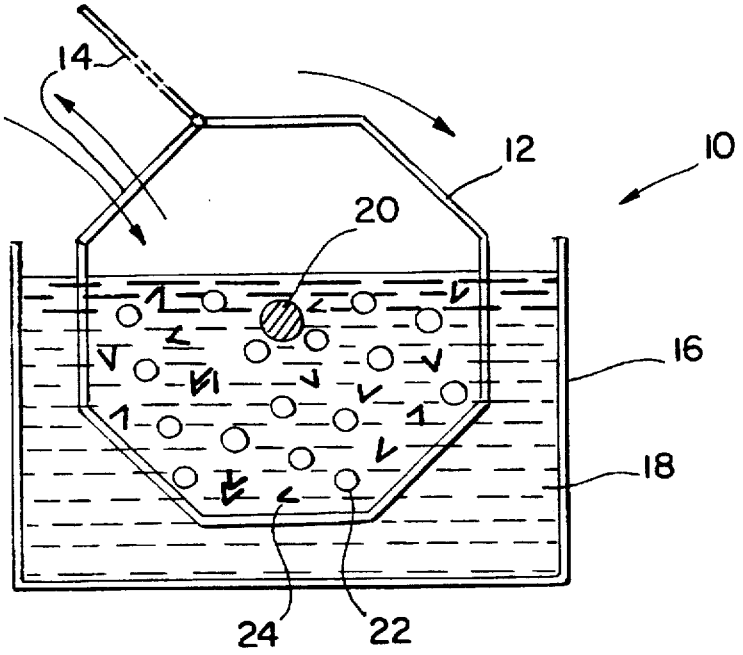
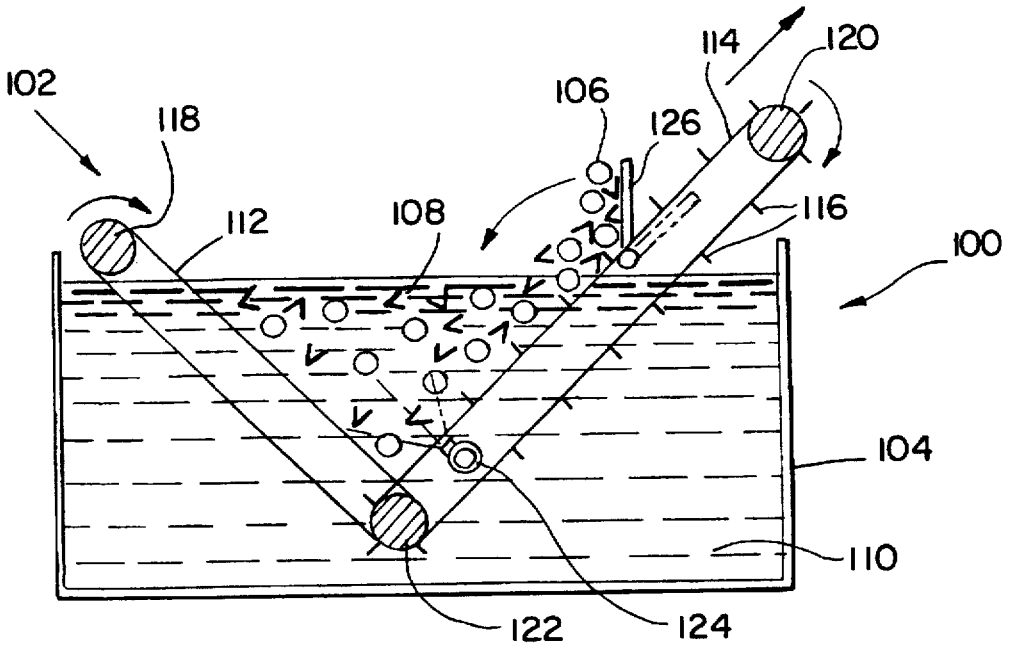
FIG. 2

CLEANING SYSTEM FOR ELONGATED OBJECTS

BACKGROUND OF THE INVENTION

1. Field of the Invention

The present invention relates to a system for washing elongated objects. More particularly, it relates to a system for washing sticks or rods which have been used for cooking and/or chilling food products.

2. Background of the Art

In the processed meats industry, products such as hotdogs and sausages are typically suspended in link form from stainless steel sticks or rods for cooking and chilling. The sticks are usually three to four feet long and are either tubular or have a V-shaped cross-section. Following removal of the product from the sticks, the sticks must be cleaned before being reused. Typically, meat processors using a large quantity of sticks have employed drum-type washers to clean them. Such washers usually consist of a round or octagonal shaped drum with a side access door.

FIG. 1 shows an example of an octagonal shaped drum-type washer 10. Such a prior art washing system included a vessel 16 containing cleaning solution 18. The drum 12 is supported in the vessel 16 by a drive shaft 20. The sticks are loaded into the drum via door 14 and the cleaning process begins by turning the drum 12 via the drive shaft 20. The sticks may be either tubular 22 or have a V-shaped cross-section 24.

Thus, the sticks are manually placed in the drum and the drum is rotated in the cleaning solution. This produces some tumbling action between the sticks but tends to confine and block cleaning solution from effectively penetrating the core of the stick load in the drum. Further, the sticks with the V-shaped cross-section are prone to bunching and nesting which limits any mixing or migration of the sticks through the drum. Also, cleaning solution must be dumped after the wash cycle to allow refilling the unit with rinse water.

Another prior art apparatus for treating rods and pipes is disclosed in J. Moltrup, U.S. Pat. No. 1,393,633. The system disclosed in this patent includes a machine divided into separate pickling and washing compartments. The rods are organized into bundles or bunches and each bundle is inserted in a carrier. The carriers are placed on a runway which conveys the carrier into each compartment. As each carrier reaches the lower end of the runway, it is caught by conveyor with flights and conveyed out of the compartment. One drawback of this system is that the rods must be placed in individual carriers and must be moved therefrom after exiting the apparatus Also, there is no provision in the individual carriers for insuring that the rods and sticks are well mixed.

Another washing apparatus is disclosed by W. Morgan, U.S. Pat. No. 1,751,838. This apparatus is used for preparing cane stalks. The cleaning tank is provided with a hopper having inclined ends which direct the cane stalks onto a looped-shaped conveyor located adjacent to the bottom of the hopper. Another conveyor which shares a shaft with the loop-shaped conveyor conveys the cane stalks out of the hopper. Each of the conveyors is provided with a series of fingers which positively moves the cane stalks from the infeed of the hopper to the outfeed of the hopper. One drawback of this system is that the cane stalks can short circuit the desired tumbling action in the circular conveyor by being removed too soon by the outfeed conveyor.

It can be seen that an improved system is needed for washing elongated objects such as sticks, rods, or other similar items. Specifically, the need exists for a washing system which is convenient to load and unload and which insures the adequate mixing and tumbling of the sticks or the like.

BRIEF SUMMARY OF THE INVENTION

One aspect of the present invention provides an apparatus for cleaning elongated objects comprising: a tank having side and bottom walls for holding cleaning solution, wherein the tank also has a feed end and an exit end, both ends being adapted for the elongated objects; a first conveyor mounted inside the tank and downwardly inclined from the feed end toward the tank bottom, wherein the first conveyor has at least two spaced apart chains in which the spacing between the chains is adapted for supporting the elongated objects; a second conveyor mounted inside the tank and upwardly inclined from the bottom toward the exit end such that the planes of the first and second conveyors intersect near the tank bottom to form an angular section having an angle of less than 180°, wherein the second conveyor has at least two spaced apart chains in which the spacing between the chains is adapted for supporting the elongated objects and wherein the chains of the second conveyor have pusher flights; a jet manifold capable of producing a jet stream which is mounted in the tank such that the jet stream can be directed at the angular section formed by the planes of the first and second conveyors; a plate mounted between the chains of the second conveyor which can assume a first position below the plane of the second conveyor and a second position above the plane of the second conveyor; and a means for driving the conveyors.

Preferably, the angular section has an angle of about 90°, the chains of the first conveyor are inboard of the chains of the second conveyor, and the tank comprises an overflow means for maintaining a maximum level of cleaning solution.

Preferably, the second position of the plate is above the maximum level that can be assumed by the cleaning solution.

Preferably, the feed end includes a hopper for feeding the elongated objects into the angular section formed by the planes of the first and second conveyors and the exit end includes a rinse tank for receiving the elongated objects from the second conveyor.

Another aspect of the present invention provides an apparatus for cleaning elongated objects comprising: a tank having side and bottom walls for holding cleaning solution, wherein the tank also has a feed end and an exit end, both ends being adapted for the elongated objects; a first continuous loop conveyor mounted inside the tank around a first shaft and a second shaft such that the first conveyor is downwardly inclined from the feed end toward the tank bottom, wherein the first conveyor has at least two spaced apart chains in which the spacing between the chains is adapted for supporting the elongated objects; a second continuous loop conveyor mounted inside the tank around the second shaft and a third shaft such that the second conveyor is upwardly inclined from the second shaft toward the exit end such that the top loops of the first and second conveyors form an angular section having an angle of less than 180°, wherein the second conveyor has at least two spaced apart chains offset from those of the first conveyor and in which the spacing between the chains is adapted for supporting the elongated objects and wherein the chains of the second conveyor have pusher flights; a jet manifold capable of producing a jet stream which is mounted in the tank such that the jet stream can be directed at the angular section formed by the top loops of the first and second conveyors; a plate mounted between the second conveyor chains which can assume a first position below the plane of the top loop of the second conveyor and a second position above the plane of the top loop of the second conveyor; and a means for driving the conveyors.

Preferably, the angular section has an angle of about 90°, the chains of the first conveyor are inboard of the chains of the second conveyor, and the tank comprises an overflow means for maintaining a maximum level of cleaning solution.

Preferably, the second position of the plate is above the maximum level that can be assumed by the cleaning solution.

Preferably, the feed end includes a hopper for feeding the elongated objects into the angular section formed by the top loops of the conveyors and the exit end includes a rinse tank for receiving the elongated objects from the second conveyor.

It is preferred that a motor be linked to the third shaft for driving the first and second conveyors.

A still further aspect of the invention provides a method of cleaning elongated objects comprising feeding the elongated objects to the above apparatus; operating the conveyors with the plate in the second position for a predetermined time; and removing the elongated objects from the apparatus by placing the plate in its first position.

The objects of the present invention therefore include providing a washing system of the above kind:

(a) which efficiently cleans elongated objects without the stagnant zones common in the prior art;

(b) which provides efficient loading and unloading of the elongated objects; and (c) which provides a system wherein the cleaning solution can be reused for subsequent loads.

These and still other objects and advantages of the present invention (e.g., methods of using the system) will be apparent from the description which follows. The following description is merely of the preferred embodiments. Thus, the claims should be looked to in order to understand the full scope of the invention.

BRIEF DESCRIPTION OF THE DRAWINGS

FIG. 1 is a schematic of a prior art washing system;

FIG. 2 is a schematic of the apparatus of the present invention;

DETAILED DESCRIPTION OF THE INVENTION

Figure 3:
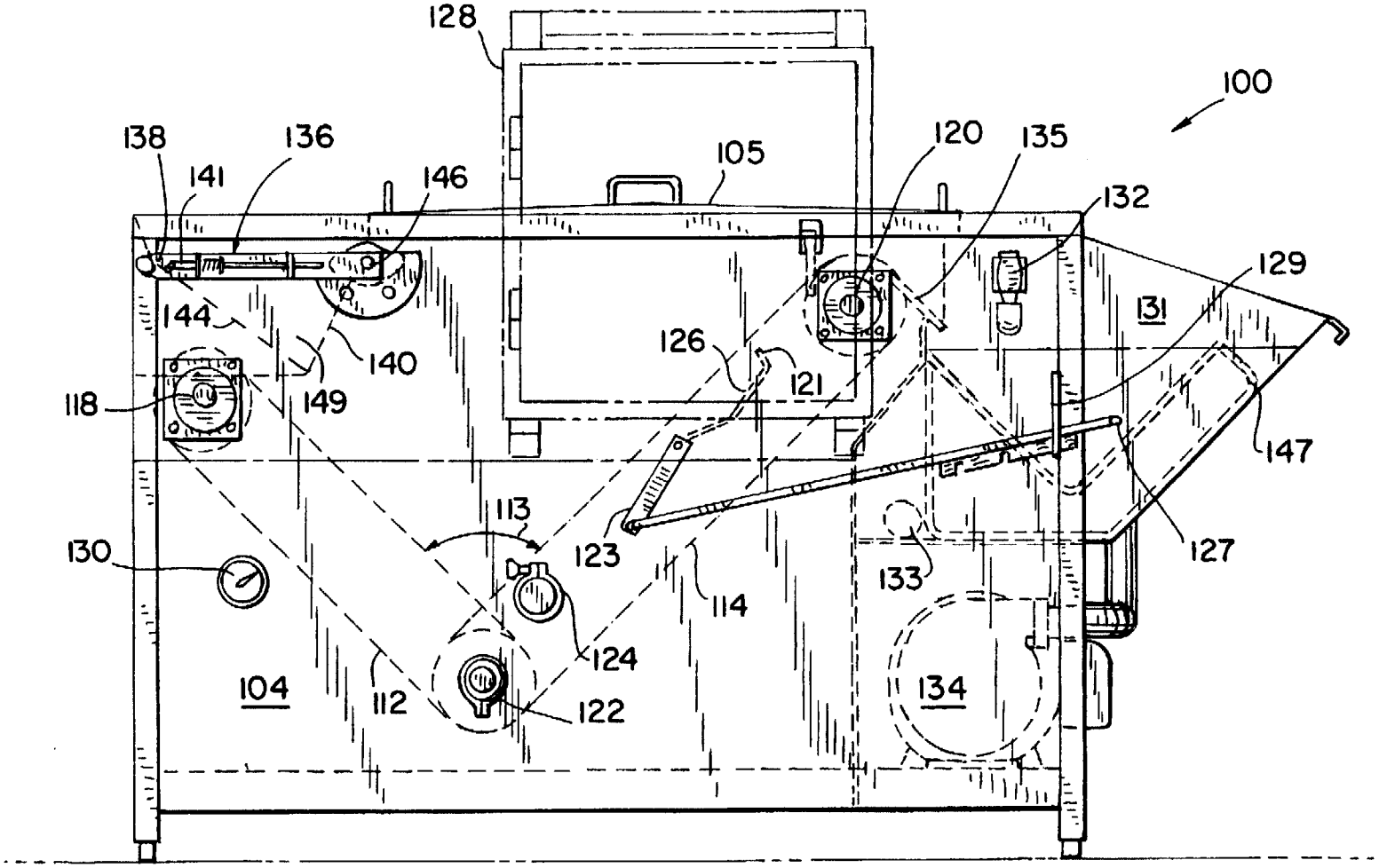
FIG. 3 is a left side elevational view thereof.
Figure 4:
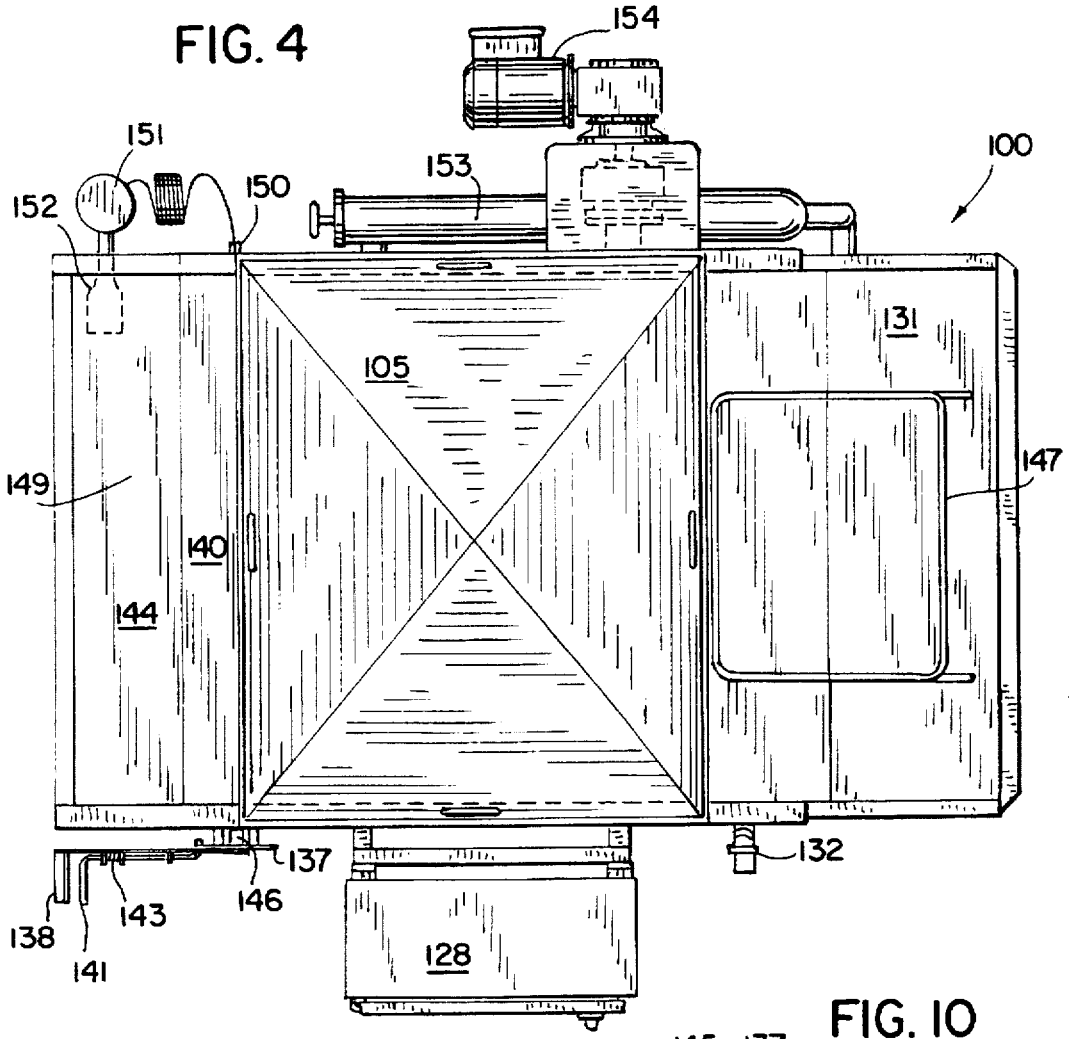
FIG. 4 is a top plan view thereof.
Figure 10:
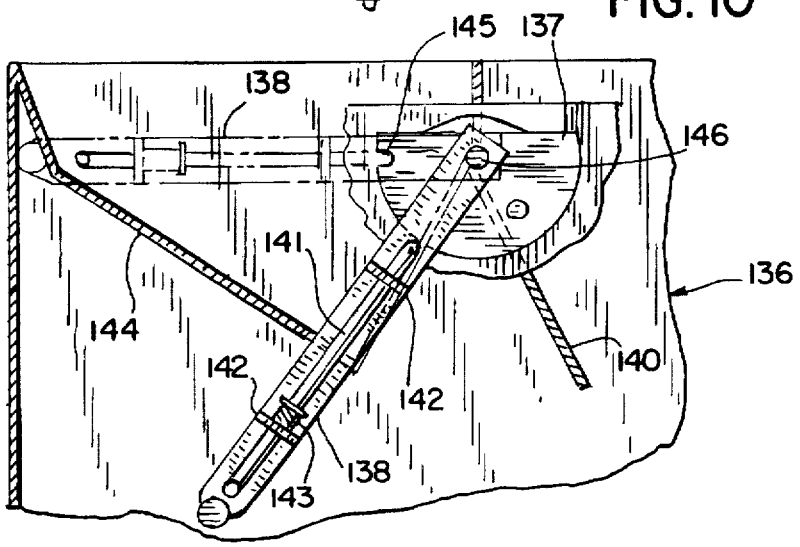
FIG. 10 is a fragmentary blowup detail of the inlet hopper assembly.
Figure 5:
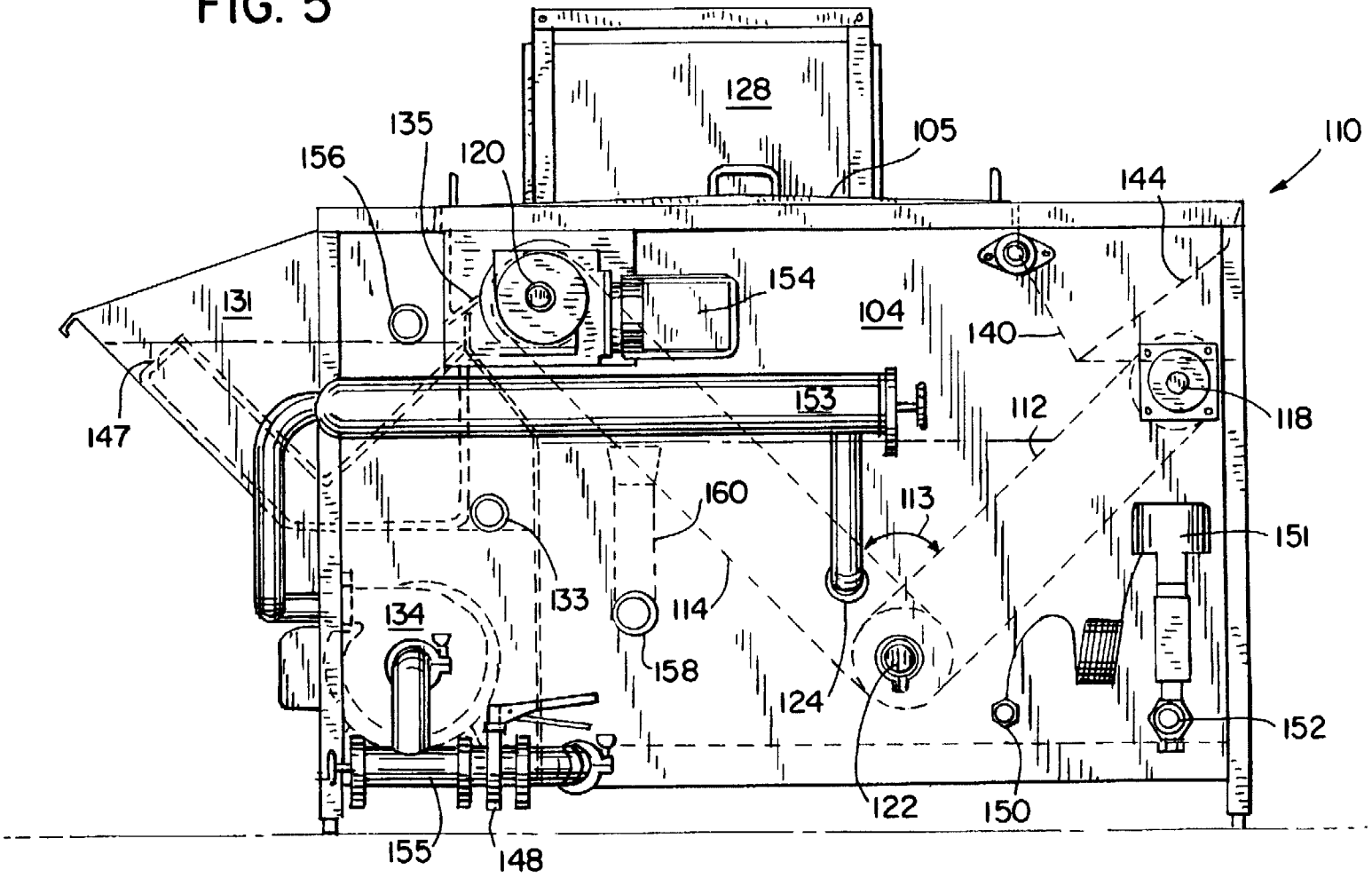
FIG. 5 is a right side elevational view thereof.
Figure 6:
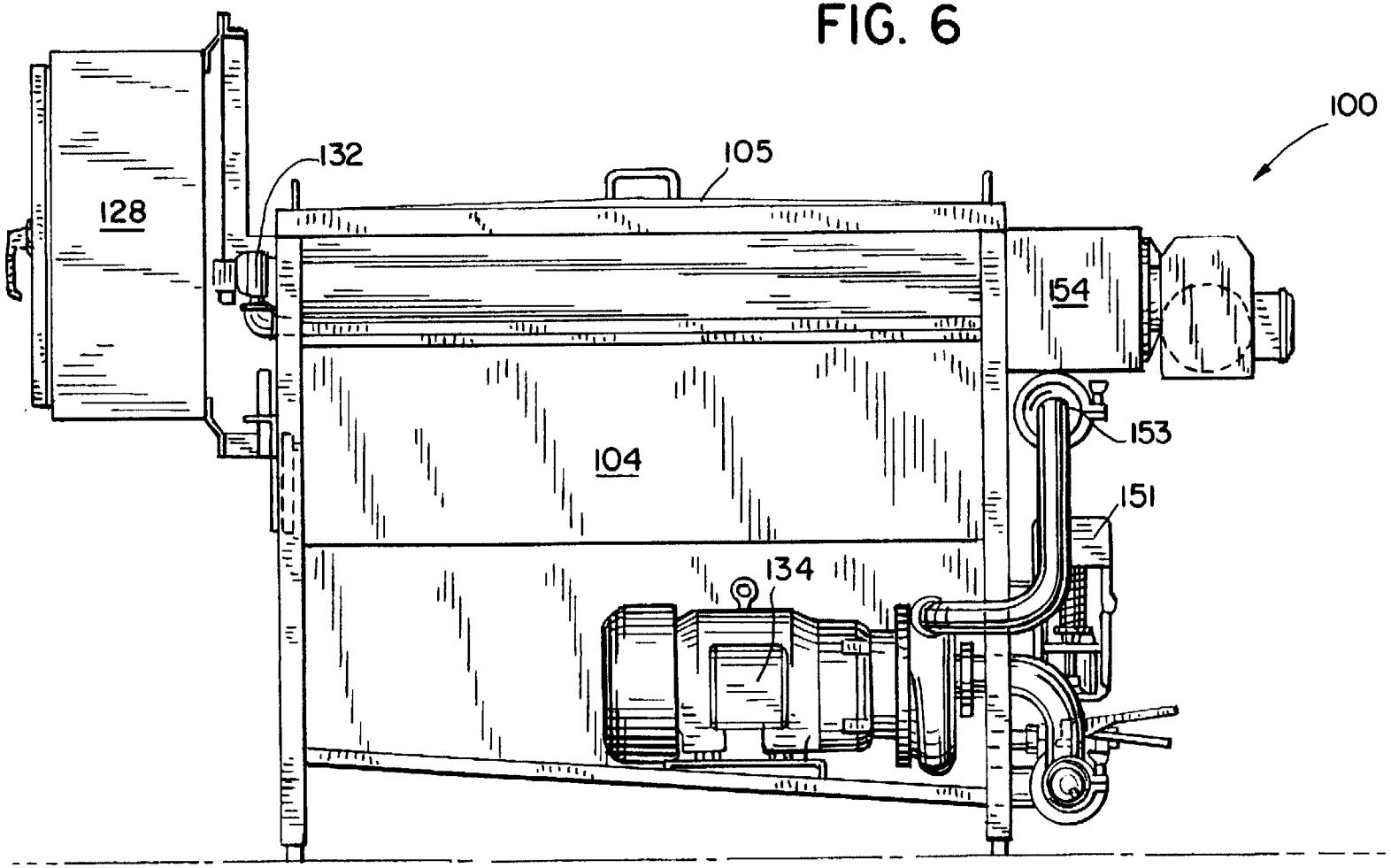
FIG. 6 is an exit end view thereof.

FIG. 2 shows a schematic representation of the apparatus and method of the present invention. The washing system is designated as element 100. The present invention replaces the prior art drum 12 with two sets of conveyor chains disposed at about a 90° angle to each other and which share a common shaft at the bottom center of the vessel 104. The infeed conveyor 112 is installed around infeed conveyor shaft 118 and infeed/outfeed conveyor shaft 122. The infeed conveyor 112 has no flights or fingers.

The outfeed conveyor 114 is installed around outfeed conveyor shaft 120 and infeed/outfeed conveyor shaft 122. The outfeed conveyor 114 has pusher flights 116 which act to engage the tubular sticks 106 and/or the V-shaped cross-section sticks 108 to move the sticks out of the cleaning solution 110 contained in vessel 104. The flip back plate 126 when engaged in a raised position causes the sticks to eject from the outfeed conveyor 114 during the cleaning cycle. Direct impingement of the cleaning solution 110 is provided on the bottom of the stick pile by a jet manifold 124.

During operation of a cleaning cycle, the infeed conveyor 112 and the outfeed conveyor 114 are run simultaneously. The outfeed conveyor 114 with the pusher flights 116 pull sticks off the bottom of the pile and convey them upwards until they reach the flip back plate 126. The flip back plate 126 peels the sticks off the outfeed conveyor 114. The infeed conveyor 112 pulls the stick pile down towards the outfeed conveyor 114 so that a layer of sticks is being pulled off the bottom of the pile at all times. The shearing action at the bottom of the pile tends to separate and de-nest the sticks. At the end of the cleaning cycle, the flip back plate 126 is retracted and the sticks are conveyed out of the vessel 104 by the outfeed conveyor 114 into an adjacent tank for rinsing. Thus, the cleaning solution can be saved for the next batch of sticks.

As set forth below, the stick washing system of the present invention facilitates automatic loading and unloading of the sticks. Also the flip back plate 126 and outfeed conveyor 114 ensure that sticks are pulled off the bottom of the pile and returned to the top of the pile. Both of these advantages are surprising and unexpected improvements over the prior art drum type washer. The dynamics of the stick pile are not fully understood, but through testing it has been determined that the infeed conveyor 112 must be operated to get proper circulation of sticks in the pile. When the infeed conveyor 112 is shut off, the back of the stick pile stagnates and does not get pulled down into the outfeed conveyor 114.

Referring now to FIGS. 3–10, the stick washing system of the present invention is designated by element 100. The vessel 104 is designed to accommodate sticks having a typical length of 36–48 inches long. However, the apparatus can be modified in obvious ways to accommodate sticks of any size. The washing system 100 is equipped with a cover 105 which may be removed for easy access to the internals of the vessel 104. A control cabinet 128 is provided for housing the electrical components associated with pump motor, conveyor shaft motor, solenoid/regulators, etc.

Thermometer 130 is provided on the side of the vessel 104 which directly measures the temperature of the cleaning solution 110. Temperature control of the cleaning solution is accomplished by thermowell 150 which is operably connected to steam regulator 151. When the temperature of the cleaning solution falls below the desired set point, the steam regulator 151 will open allowing steam to be introduced into steam mixer 152 mounted inside the vessel 104.

The surprising and unexpected advantages of the present stick washing system resides in the configuration of conveyors 112 and 114. As shown in the figures, an infeed conveyor shaft 118 is located near the top of the tank 104 at the inlet end thereof. An infeed/outfeed conveyor shaft 122 is located on the wash tank near its center and bottom. Finally, an outfeed conveyor shaft 120 is located near the top of the tank 104 at the exit end thereof. The conveyor shafts 118, 120, and 122 are preferably equipped with hubs for accepting the conveyor chains.

Figure 8:
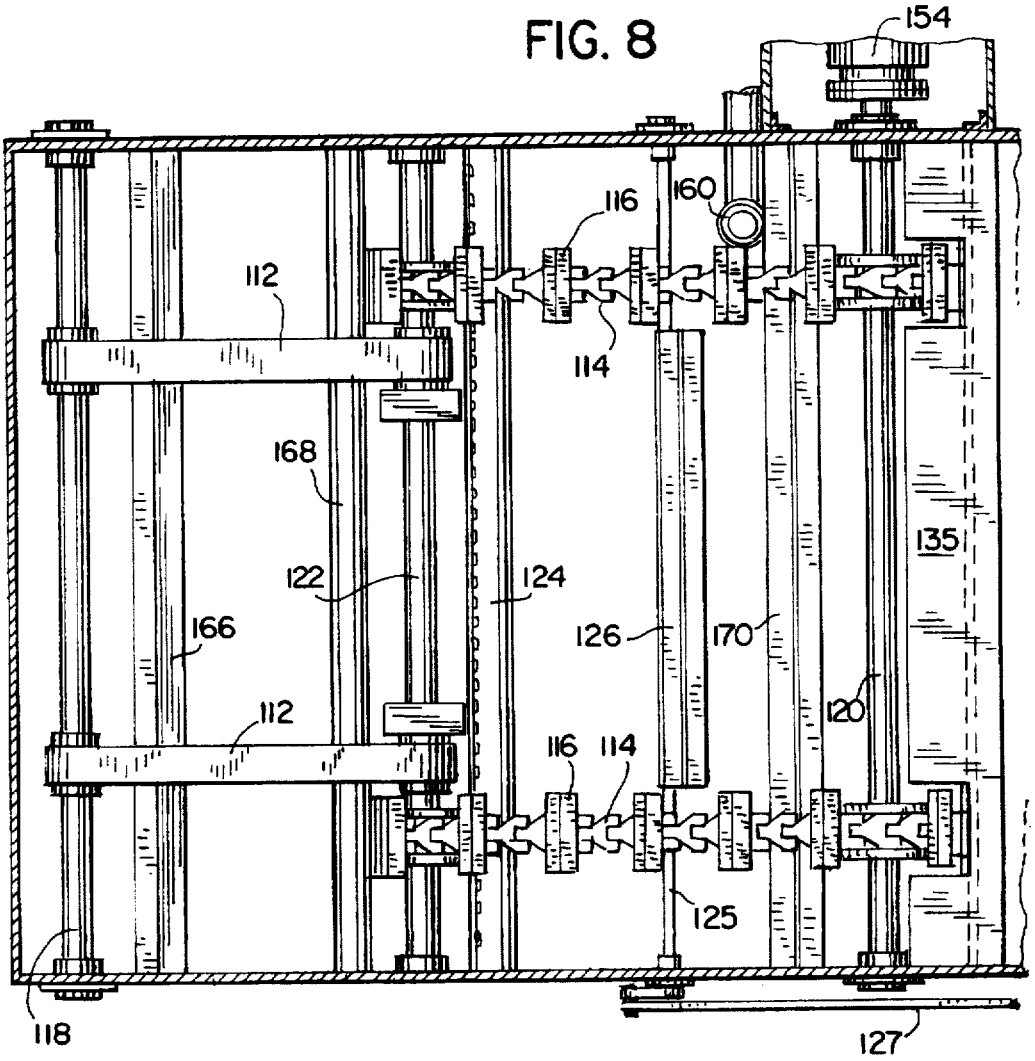
FIG. 8 is a cross-sectional view thereof taken along the line 8—8 of FIG. 7.

Referring to FIG. 8, the infeed conveyors 112 are offset from the outfeed conveyors 114. As shown in FIG. 8, the two infeed conveyors 112 are inboard of the outfeed conveyors 114. Although the preferred embodiment shows two infeed conveyor chains 112 and two outfeed conveyor chains 114, any number of chains may be used as long as the infeed conveyors and outfeed conveyors are staggered. The conveyors are preferably made of polymeric chains but may be any acceptable material which is compatible with the cleaning solution.

Figure 7:
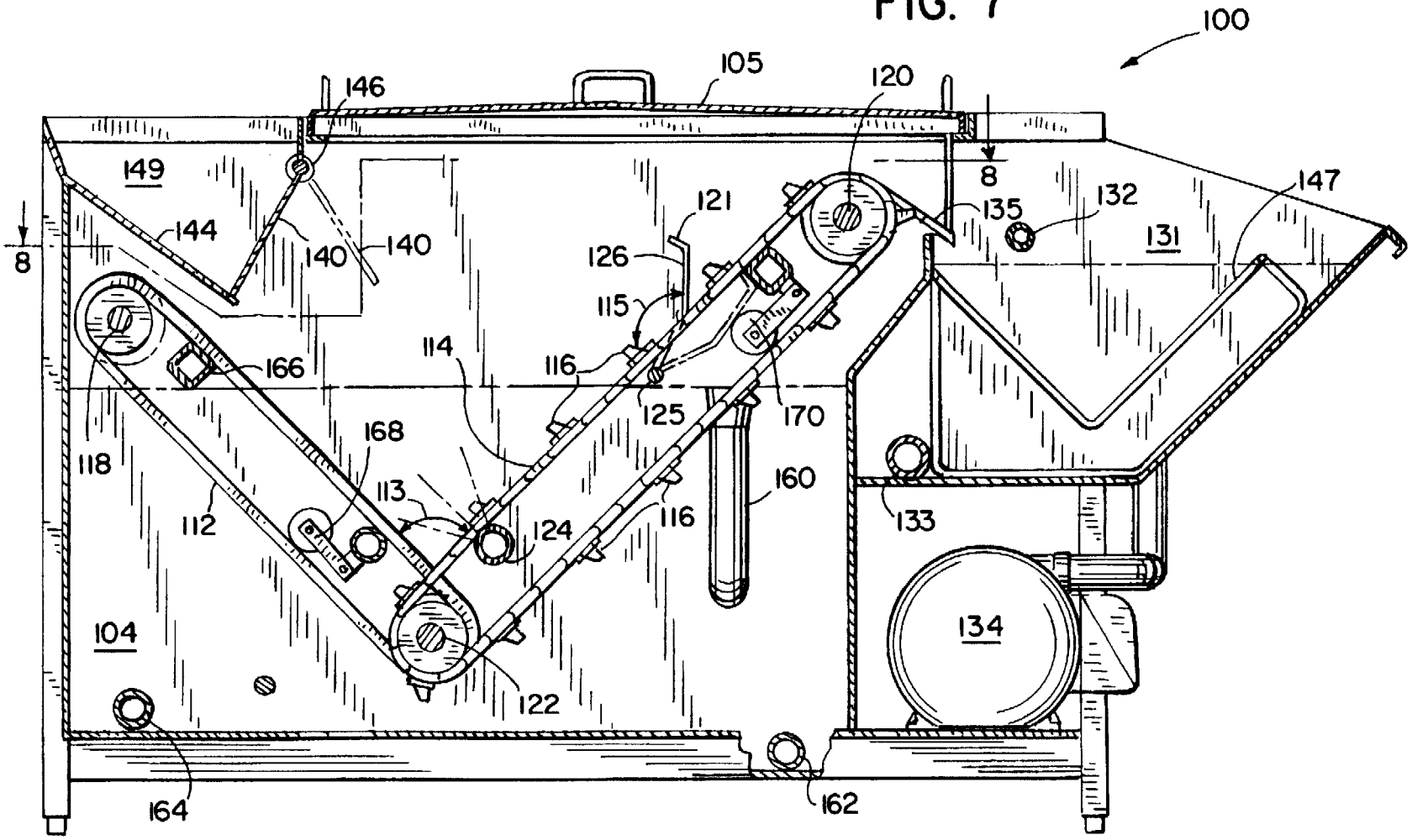
FIG. 7 is a typical longitudinal cross-sectional view thereof.

As shown is FIGS. 7 and 8, tension is maintained on the conveyors by infeed conveyor tension bar 166, outfeed conveyor tensioner 170, and infeed conveyor tensioner 168. Tensioners 168 and 170 may be spring loaded arms with a roller in contact with its respective conveyor. Alternatively, the tensioners 168 and 170 can have arms secured with a nut and bolt.

Also, outfeed conveyor 114 includes pusher flights 116 for conveying the sticks out of the cleaning solution and into the discharge end of the wash tank 104.

The conveyor shafts are preferably arranged so that the planes of the infeed conveyor 112 and outfeed conveyor 114 form an angular section having an angle 113 from about 80° to about 110°. More preferred is an angle of about 90° to 100°. The angular section formed by the conveyor planes most preferably has an angle of about 90°. When the angle 113 is significantly less than about 90°, the infeed conveyor 112 pushes the sticks backward against the stick flow generated by the outfeed conveyor 114. If the angle 113 between the conveyors is reduced significantly below 90° (about 80°), a jam will occur as the conveyors attempt to move the sticks in opposite directions. At an angle 113 significantly greater than 100°(about 110°): (1) the stick pile flattens and reduces the number of sticks held by the conveyors; (2) the reduction in depth of the stick pile diminishes the ability of the pile to hold the sticks on the conveyors against the force of the water from the jet manifold 124; and (3) the stick pile begins to move up the outfeed conveyor 114 as a solid mass rather than a single layer of sticks causing erratic mixing of the stick pile and jams at the flip back plate 126.

The conveyors 112 and 114 may be propelled by applying power at any one of the conveyor shafts 118, 122, or 120, but preferably the driven shaft is the outfeed conveyor shaft 120. Motor 154 is used to drive shaft 120 and advantageously has a variable speed so that the conveyor speed may be adjusted to suit the particular washing application.

Figure 9:
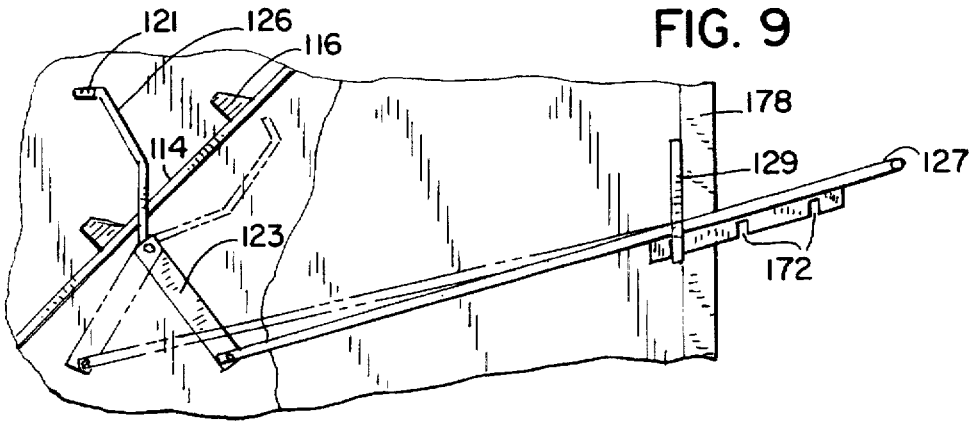
FIG. 9 is a fragmentary blowup detail of the flipper plate assembly.

As shown in FIGS. 7–9, the flip back plate 126 is mounted on a flip back plate shaft 125 which is located just beneath the upper chains of the outfeed conveyor 114. In the retracted position, the flip back plate 126 is just below the plane formed by the upper chains of the outfeed conveyor 114. In the deployed position, flip back plate 126 protrudes above the plane formed by the upper chains of the outfeed conveyor 114. The flip back plate 126 is disposed on its shaft 125 and fills the gap between the chains of outfeed conveyor 114 (FIG. 8).

Turning to FIG. 9, a detail of the flip back plate mechanism is shown. The flip back plate arm 127 is pivotally attached to a flip back plate arm extension 123. The flip back plate arm extension 123 is fixedly attached in turn to the flip back plate 126. The end of the flip back plate arm 127 opposite the extension 123 includes notches 172.

As shown in FIG. 9, a latch plate 129 is attached to the wash tank wall 178. The length of the flip back plate arm 127 is such that when at least one of the notches 172 engages the latch plate 129 the flip back plate 126 is in a retracted position as shown by the dotted lines in FIG. 9. Similarly, at least one of the notches 172 will engage the latch plate 129 with the flip back plate 126 in the engaged position. Preferably, the flip back plate 126 has a concave lip 121 at the end opposite the flip back plate arm extension 123 to facilitate the flipping back of the sticks.

The angle 115 between the pusher flight 116 and the flip back plate 126 can be of any size as long as the sticks can be efficiently peeled off the outfeed conveyor 114 without the sticks hopping over the flip back plate 126. Preferably, the flip back plate 126 is vertical when deployed and the face of the pusher flight 116 is beveled at about 30°.

Preferably, the angle 115 between the flip back plate 126 and the face of the pusher flight 116 is about 75°. This prevents the sticks from jamming. The lip 121 of the flip back plate 126 forces the sticks to fall back in the desired direction.

Another important feature of the present invention is the jet manifold 124. As best seen in FIG. 7, it is situated just under the upper chain of the outfeed conveyor 114. As best seen in FIG. 8, the jet manifold 124 has a series of holes drilled along it. The jet manifold 124 is situated just above the V formed by the intersection of the planes of infeed conveyor 112 and the outfeed conveyor 114. In this manner, a jetstream can be directed at the sticks for effective cleaning because the pile of sticks on the conveyor chains prevent scattering of the lower sticks when impinged by the jetstream. The recirculation pump 134 takes cleaning solution from the pump suction nozzle 162 and pumps it through screen strainer 153 and then into the jet manifold 124. The suction line of the pump 134 is also supplied with a shutoff valve 148 and a basket strainer 155.

Referring to FIGS. 3, 4, 7, and 10 the wash system of the present invention is supplied with an inlet hopper 149 and inlet hopper door assembly 136. Inlet hopper 149 consists of an inlet hopper floor 144 and an inlet hopper door 140. The inlet hopper door 140 is hinged at inlet hopper door shaft 146. In the open position, the inlet hopper door 140 allows the sticks to fall into the V created by the intersection between the planes of the infeed conveyor 112 and outfeed conveyor 114. The inlet hopper door shaft 146 is further connected to a handle 138. Mounted between the handle 138 and the wall of vessel 104 is an arcuate end plate 137. The arcuate end plate 137 has a detent 145. The handle 138 is fitted with locking pin tabs 142 through which is fitted locking pin 141. Locking pin 141 is fitted with a spring 143 so that when the handle 138 is in a substantially horizontal position the end of the locking pin 141 engages the detent 145.

The level of the cleaning solution in the vessel 104 is maintained by the skimmer overflow standpipe 160 which empties into the overflow nozzle 158. If desired, the vessel 104 may be drained via vessel drain 164. The end of the vessel opposite the inlet hopper 149 is equipped with a rinse tub 131. Sticks discharge into the rinse tub 131 by falling off the outfeed conveyor 114 and over the conveyor discharge lip 135. The sticks fall onto the discharge rinse rack 147 which sits in the bottom of the rinse tub 131. The rinse tub is equipped with a water valve 132 for supplying the rinse tub 131 with water. The rinse tub has a drain 133 at its bottom. The level on the rinse tub is maintained by the overflow 156.

In general, all materials of construction for the present invention are 304 stainless steel.

We claim:

1. An apparatus for cleaning elongated objects comprising:

a tank having side and bottom walls for holding cleaning solution, wherein the tank also has a feed end and an exit end, both ends being adapted for the elongated objects;

a first conveyor mounted inside the tank and downwardly inclined from the feed end toward the tank bottom, wherein the first conveyor has at least two spaced apart chains in which the spacing between the chains is adapted for supporting the elongated objects;

a second conveyor mounted inside the tank and upwardly inclined from the bottom toward the exit end such that the planes of the first and second conveyors intersect near the tank bottom to form an angular section, wherein the second conveyor has at least two spaced apart chains in which the spacing between the chains is adapted for supporting the elongated objects and wherein the chains of the second conveyor have pusher flights;

a jet manifold capable of producing a jet stream which is mounted in the tank such that the jet stream can be directed at the angular section formed by the planes of the first and second conveyors;

a plate mounted between the chains of the second conveyor which can assume a first position below the plane of the second conveyor and a second position above the plane of the second conveyor; and a means for driving the conveyors.

2. The apparatus of claim 1, wherein the angular section has an angle of about 80° to about 110°.

3. The apparatus of claim 2, wherein the angular section has an angle of about 90° to about 100°.

4. The apparatus of claim 3, wherein the angular section has an angle of about 90°.

5. The apparatus of claim 1, wherein the chains of the first conveyor are inboard of the chains of the second conveyor.

6. The apparatus of claim 1, wherein the tank further comprises an overflow means for maintaining a maximum level of cleaning solution.

7. The apparatus of claim 6, wherein the second position of the plate is above the maximum level that can be assumed by the cleaning solution.

8. The apparatus of claim 1, wherein the feed end includes a hopper for feeding the elongated objects into the angular section formed by the planes of the first and second conveyors.

9. The apparatus of claim 8, wherein the exit end includes a rinse tank for receiving the elongated objects from the second conveyor.

10. An apparatus for cleaning elongated objects comprising:

a tank having side and bottom walls for holding cleaning solution, wherein the tank also has a feed end and an exit end, both ends being adapted for the elongated objects;

a first continuous loop conveyor mounted inside the tank around a first shaft and a second shaft such that the first conveyor is downwardly inclined from the feed end toward the tank bottom, wherein the first conveyor has at least two spaced apart chains in which the spacing between the chains is adapted for supporting the elongated objects;

a second continuous loop conveyor mounted inside the tank around the second shaft and a third shaft such that the second conveyor is upwardly inclined from the second shaft toward the exit end such that the top loops of the first and second conveyors form an angular section, wherein the second conveyor has at least two spaced apart chains offset from those of the first conveyor and in which the spacing between the chains is adapted for supporting the elongated objects and wherein the chains of the second conveyor have pusher flights;

a jet manifold capable of producing a jet stream which is mounted in the tank such that the jet stream can be directed at the angular section formed by the top loops of the first and second conveyors;

a plate mounted between the second conveyor chains which can assume a first position below the plane of the top loop of the second conveyor and a second position above the plane of the top loop of the second conveyor; and a means for driving the conveyors.

11. The apparatus of claim 10, wherein the angular section has an angle of about 80° to about 110°.

12. The apparatus of claim 11, wherein the angular section has an angle of about 90° to about 100°.

13. The apparatus of claim 12, wherein the angular section has an angle of about 90°.

14. The apparatus of claim 13, wherein the chains of the first conveyor are inboard of the chains of the second conveyor.

15. The apparatus of claim 14, wherein the tank further comprises an overflow means for maintaining a maximum level of cleaning solution.

16. The apparatus of claim 15, wherein the second position of the plate is above the maximum level that can be assumed by the cleaning solution.

17. The apparatus of claim 16, wherein the feed end includes a hopper for feeding the elongated objects into the angular section formed by the top loops of the conveyors.

18. The apparatus of claim 17, wherein the exit end includes a rinse tank for receiving the elongated objects from the second conveyor.

19. The apparatus of claim 18, wherein a motor is linked to the third shaft for driving the first and second conveyors.

20. A method of cleaning elongated objects comprising:

feeding the elongated objects to the apparatus of claim 1;

operating the conveyors with the plate in the second position for a predetermined time; and removing the elongated objects from the apparatus by placing the plate in its first position.

21. A method of cleaning elongated objects comprising:

feeding the elongated objects to the apparatus of claim 10;

operating the conveyors with the plate in the second position for a predetermined time; and removing the elongated objects from the apparatus by placing the plate in its first position.

* * * * *